US011889920B2

(12) United States Patent
Zou et al.

(10) Patent No.: US 11,889,920 B2
(45) Date of Patent: Feb. 6, 2024

(54) ELECTRIC SLIDE RAIL

(71) Applicant: WUXI HAIDAER PRECISION SLIDES CO., LTD, Jiangsu (CN)

(72) Inventors: Lian Zou, Jiangsu (CN); Xinglong Xu, Jiangsu (CN); Feng Qian, Jiangsu (CN); Kai Dai, Jiangsu (CN); Qiang Ji, Jiangsu (CN)

(73) Assignee: WUXI HAIDAER PRECISION SLIDES CO., LTD, Jiangsu (CN)

( * ) Notice: Subject to any disclaimer, the term of this patent is extended or adjusted under 35 U.S.C. 154(b) by 111 days.

(21) Appl. No.: 17/624,550

(22) PCT Filed: Jul. 3, 2020

(86) PCT No.: PCT/CN2020/100059
§ 371 (c)(1),
(2) Date: Jan. 3, 2022

(87) PCT Pub. No.: WO2021/068574
PCT Pub. Date: Apr. 15, 2021

(65) Prior Publication Data

US 2022/0265046 A1 Aug. 25, 2022

(30) Foreign Application Priority Data

Oct. 12, 2019 (CN) ..... 201910969201.5

(51) Int. Cl.
*A47B 88/457* (2017.01)
*F25D 25/02* (2006.01)

(52) U.S. Cl.
CPC ..... *A47B 88/457* (2017.01); *F25D 25/025* (2013.01); *A47B 2210/0002* (2013.01); *A47B 2210/175* (2013.01)

(58) Field of Classification Search
CPC ..... A47B 88/457; A47B 2210/0002; A47B 2210/175; A47B 88/40; A47B 88/45; A47B 2210/0078; F25D 25/025
See application file for complete search history.

(56) References Cited

U.S. PATENT DOCUMENTS 8,395,334 B2 * 3/2013 Eom ..... F25D 25/025 318/265
2010/0236280 A1 * 9/2010 Eom ..... A47B 88/40 62/449

FOREIGN PATENT DOCUMENTS

CN 102278861 A * 12/2011
CN 102635997 A * 8/2012
CN 102635997 A 8/2012
(Continued)

*Primary Examiner* — Kimberley S Wright

(57) ABSTRACT

An improved electric slide rail includes a motor driving device and two slide rail assemblies symmetrically arranged. Every slide rail assembly includes a slide rail and a fixed rail, wherein the slide rail is slidably sleeved on the fixed rail, a rack housing is sleeved on an outer side of the fixed rail, a rack is provided on the rack housing, a gear engaged with the rack is mounted on the slide rail; the motor driving device is installed on the slide rail through a fixing device and is electrically connected with a controller. The improved electric slide rail further includes a clutch which is electrically connected with the controller, wherein the clutch is arranged at a side where an output shaft of a motor of the motor driving device is provided, and is connected with the slide rail through a linkage structure.

5 Claims, 15 Drawing Sheets

(56) References Cited

FOREIGN PATENT DOCUMENTS

| | | | | | |
|---|---|---|---|---|---|
| CN | 204158017 U | * | 2/2015 | | |
| CN | 110074572 A | * | 8/2019 | ..... | A47B 88/423 |
| CN | 110074572 A | | 8/2019 | | |

* cited by examiner

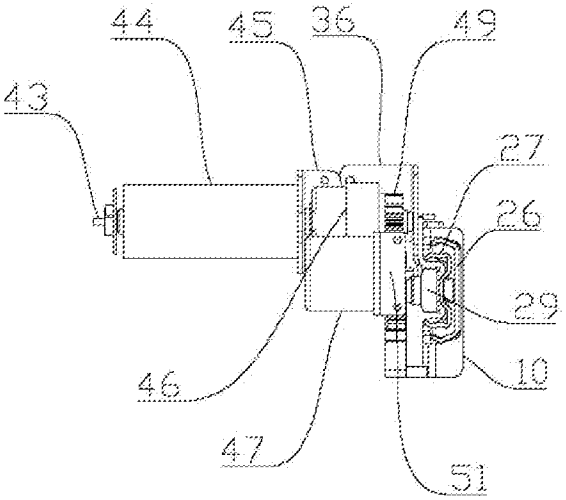
Fig. 15
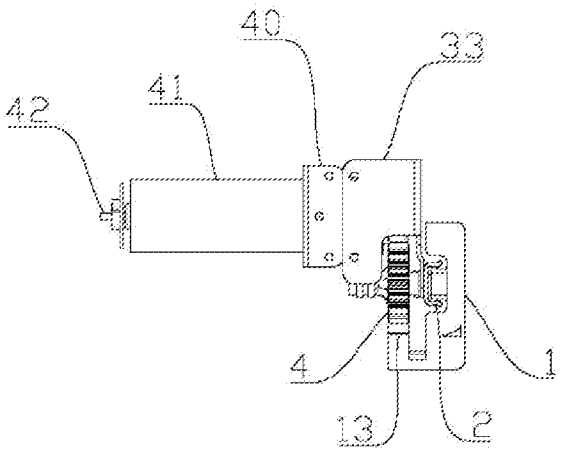
Fig. 16
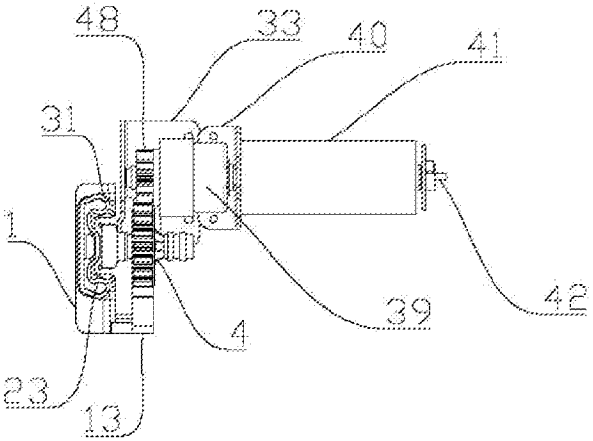
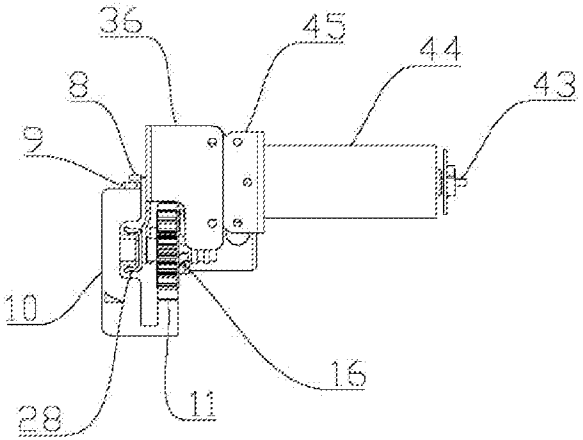

ELECTRIC SLIDE RAIL

CROSS REFERENCE OF RELATED APPLICATION

This is a U.S. National Stage under 35 U.S.C 371 of the International Application PCT/CN2020/100059, filed Jul. 3, 2020, which claims priority under 35 U.S.C. 119(a-d) to CN 201910969201.5, filed Oct. 12, 2019.

BACKGROUND OF THE PRESENT INVENTION

Field of Invention

The present invention relates to the field of slide rail technology, and more particularly to an improved electric slide rail.

Description of Related Arts

The slide rail is a connecting part installed between the drawer and the cabinet body for allowing the drawer to move in and out. Most of the existing slide rails are manual, and the user applies the pushing or pulling force to close or open the drawer. When the objects in the drawer are heavy, the user needs to apply a larger push-pull force to the drawer, which is not only laborious, but also easy to cause damage to the drawer. Especially for refrigerator drawers, if they are unable to be opened and closed in time, the refrigerator door will be opened for a long time, which is not conducive to power saving, but also affects the cooling effect of the refrigerator.

The electric slide rail driven by the motor is able to automatically push and pull the drawer, so as to make up for the shortcomings of manual pushing and pulling. However, in the existing electric slide rails, such as "an electric slide rail device for large-capacity refrigerator drawers" disclosed by CN 206531349 U, the motor drives the drive gear to drive the sliding rail bracket and the sliding rail to move horizontally along the drive rack, so that when the motor is in a power-off state, the motor shaft is still directly connected with the drive gear, the drive rack and the sliding rail. Therefore, manual pushing and pulling of the drawers also needs to overcome the rotating torque of the motor, which makes manual pushing and pulling more laborious. In addition, since the motor in the electric slide rail device disclosed by CN 206531349 U is installed between the fixed rail and the fixed rail bracket, the gap between the side walls of each drawer and the cabinet body is enlarged, which not only makes it easy for dust and water vapor to enter the gap, and affects the service life of the electric slide rail, but also reduces the volume of the drawers.

SUMMARY OF THE PRESENT INVENTION

Technical Problems to be Solved

In view of the shortcomings of the existing electric slide rail that it is more laborious to manually push and pull when the motor is powered off, and the large gap between the side walls of the drawer and the cabinet body affects the service life of the refrigerator and the volume of the drawer, the present invention provides an improved electric slide rail with simple structure, which not only achieves manual and automatic pushing and pulling of the drawer, but also achieves laborsaving manual pushing and pulling and convenient use of the drawer when the motor is powered off. Moreover, the improved electric slide rail provided by the present invention is also able to increase the capacity of the drawer and is extended in the service life.

Technical Solutions

The present invention provides technical solutions as follows.

An electric slide rail comprises a motor driving device and two slide rail assemblies symmetrically arranged, wherein each of the two slide rail assemblies comprises a slide rail and a fixed rail, wherein:

the slide rail is slidably sleeved on the fixed rail, a rack housing is sleeved on an outer side of the fixed rail, a rack is provided on the rack housing, a gear engaged with the rack is mounted on the slide rail; the motor driving device is installed on the slide rail through a fixing device, and is electrically connected with a controller;

the improved electric slide rail further comprises a clutch which is electrically connected with the controller, wherein the clutch is arranged at a side where an output shaft of a motor of the motor driving device is provided, and is connected with the slide rail through a linkage structure.

Preferably, the motor driving device comprises an encoder for measuring angular displacement of the motor or the gear; the fixing device comprises a supporting protective cover and a mounting bracket, wherein the motor driving device and the clutch are installed within the supporting protective cover, the supporting protective cover is fixed to the slide rail through the mounting bracket, a support bracket is provided within the supporting protective cover; the clutch and the motor are installed at two sides of the support bracket, respectively; the supporting protective cover has two support holes at a left end and a right end thereof, respectively; a magnet is provided at a top of the rack housing, a Hall element inductive with the magnet is installed at the mounting bracket; the two slide rail assemblies are a first slide assembly and a second slide assembly; and accordingly, there are a first slide rail and a second slide rail, there are a first fixed rail and a second fixed rail, there are a first rack housing and a second rack housing, there are a first rack and a second rack, there are a first gear and a second gear; there is a motor driving device, the linkage structure comprises a driving gear, wherein the driving gear is engaged with the second gear, a left end of the driving gear is installed on the clutch, a right end of the driving gear is rotatably inserted into one of the two support holes which is provided at the right end of the supporting protective cover; a connecting rod is provided between the first gear and the second gear, a third gear is sleeved on the connecting rod, the third gear is engaged with a driven gear, a right end of the driven gear is mounted on the encoder, a left end of the driven gear is rotatably inserted into another of the two support holes which is provided at the left end of the supporting protective cover; a support frame is provided within the supporting protective cover, the encoder is installed within the supporting protective cover through the support frame; the connecting rod comprises a transverse rod and a linkage rod, the first gear is installed at a left end of the transverse rod, a right end of the transverse rod is connected with a left end of the linkage rod through the third gear, the second gear is installed at a right end of the linkage rod; the transverse rod has a channel, the first gear and the third gear are engaged with the left end and the right end of the transverse rod through a square inserting rod;

when the electric slide rail comprises two motor driving devices which are a first motor driving device and a second motor driving device, respectively; there are two motors which are a first motor and a second motor, respectively; there are two clutches which are a first clutch and a second clutch, respectively; there are two linkage structures which are a first linkage structure and a second linkage structure, respectively; there are two fixing device which are a first fixing device and a second fixing device; there are three encoders which are a first encoder installed at the first motor, a second encoder installed at the second motor and a third encoder connected with the second slide rail;

the first fixing device comprises a first supporting protective cover and a first mounting bracket, a first support bracket is provided within the first supporting protective cover, the first clutch is arranged at a side of an output shaft of the first motor, the first support bracket is located between the first clutch and the first motor;

the first linkage structure comprises a first driving gear, wherein the first driving gear is engaged with the first gear, a left end of the first driving gear is rotatably inserted into a support hole which is provided at a left end of the first supporting protective cover, a right end of the first driving gear is connected with the first clutch, a left end of the first encoder is connected with a right end of the first motor, a right end of the first encoder is rotatably inserted into a support hole which is provided at a right end of the first supporting protective cover, the first supporting protective cover is fixed to the first slide rail through the first mounting bracket;

the second fixing device comprises a second supporting protective cover and a second mounting bracket, a second support bracket is provided within the second supporting protective cover, the second clutch is arranged at a side of an output shaft of the second motor, the second support bracket is located between the second clutch and the second motor;

the second linkage structure comprises a second driving gear, wherein the second driving gear is engaged with the second gear, a left end of the second driving gear is connected with the second clutch, a right end of the second driving gear is rotatably inserted into a support hole which is provided at a right end of the second supporting protective cover, a right end of the second encoder is connected with a left end of the second motor, a left end of the second encoder is rotatably inserted into a support hole which is provided at a left end of the second supporting protective cover, the second supporting protective cover is fixed to the second slide rail through the second mounting bracket;

a third support bracket is provided within the second supporting protective cover, the third encoder is fixed on the third support bracket, an encoder gear is installed at an end portion of the third encoder, the encoder gear is engaged with the second gear.

Beneficial Effects of the Present Invention

According to the present invention, the clutch is introduced into the electric slide rail, the torque is transmitted between the motor and the slide rail when the clutch is closed, so that the motor drives the slide rail to move linearly along the fixed rail through the clutch and the linkage structure, so as to automatically push and pull the drawer. When the motor is powered off, the clutch is disconnected, the transmission between the motor and the slide rail is disconnected, so that the motor does not work when the drawer is manually pushed and pulled, and the drawer is able to be easily pushed and pulled without overcoming the torque of the motor. Therefore, the drawer is not only able to be pushed and pulled manually and automatically, but also able to be pushed and pulled manually easily when the motor is powered off. The improved electric slide rail provided by the present invention is simple in structure, convenient to use, and is also able to protect the service life of the motor.

The motor driving device is installed on the slide rail through the fixing device. The motor driving device is installed from the side of the drawer, so that the motor driving device is located at the rear of the drawer, which effectively reduces the gap between the side wall of the drawer and the inner wall of the cabinet, prevents foreign matter such as dust from entering from both sides of the drawer when the drawer is pushed and pulled, and prolongs the service life of the electric slide rail. Compared with the electric slide rail with motors installed on both sides, the present invention is able to effectively increase the volume of the drawer.

BRIEF DESCRIPTION OF THE DRAWINGS

FIG. 15 is a structurally schematic view along D-D direction shown in FIG. 14, in which the first and second supporting protective covers are removed.

FIG. 16 is a structurally schematic view along E-E direction shown in FIG. 14, in which the first and second supporting protective covers are removed.

DETAILED DESCRIPTION OF THE PREFERRED EMBODIMENT

Figure 1:
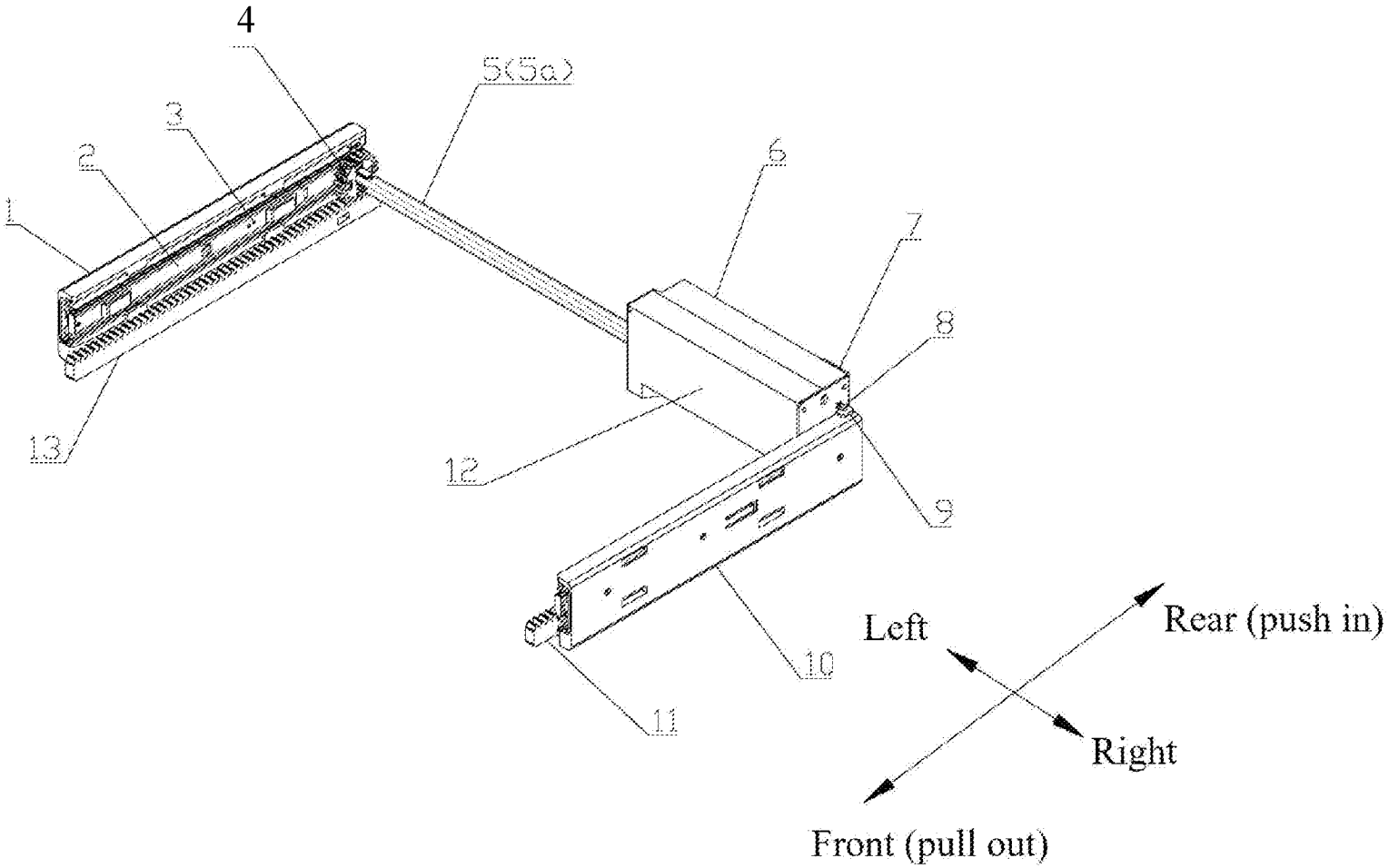
FIG. 1 is a three-dimensional schematic view of one motor driving device provided by the present invention.
Figure 2:
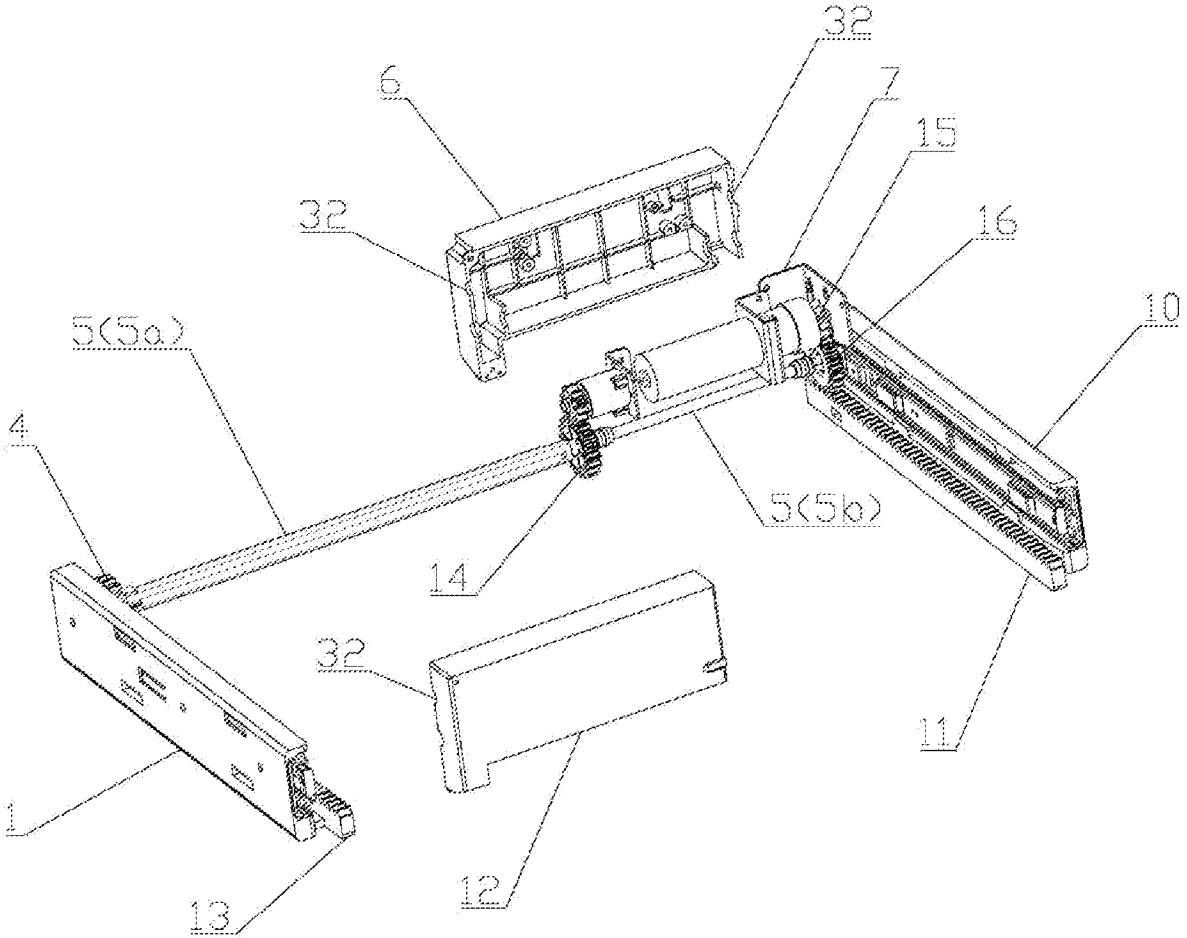
FIG. 2 is a partially exploded view of the motor driving device provided by the present invention from the first perspective.
Figure 3:
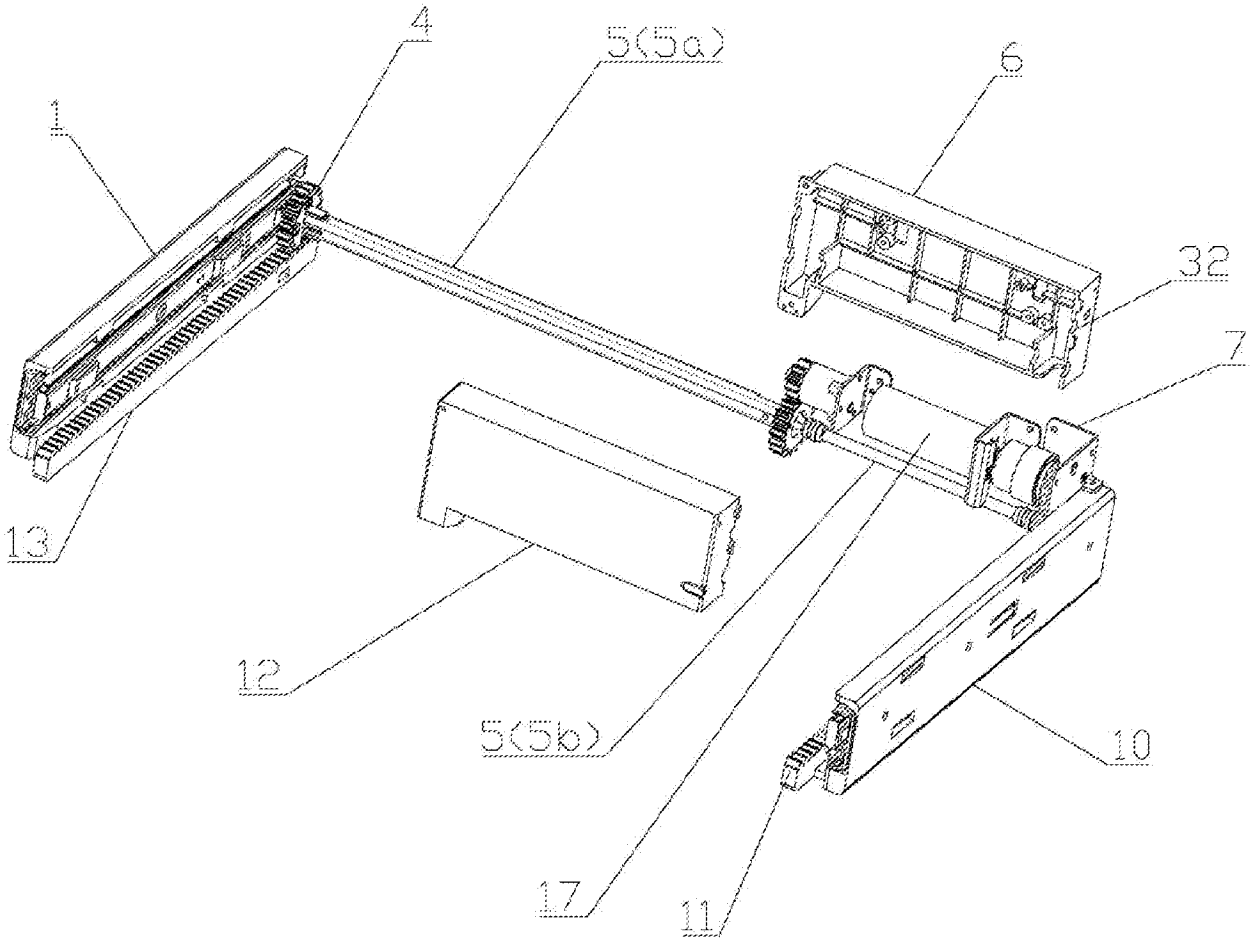
FIG. 3 is a partially exploded view of the motor driving device provided by the present invention from the second perspective.

The present invention is further explained with accompanying drawings as follows. Referring to FIGS. 1-16, an improved electric slide rail is illustrated, which comprises at least one motor driving device and two slide rail assemblies symmetrically arranged. As shown in FIGS. 1-5 and 10-13, every slide rail assembly comprises a slide rail 2 (28) and a fixed rail 31 (26), wherein the slide rail 2 (28) is slidably sleeved on the fixed rail 31 (26), a rack housing 1 (10) is sleeved on an outer side of the fixed rail 31 (26), a rack 13 (11) is provided on the rack housing 1 (10), a gear 4 (16) engaged with the rack 13 (11) is mounted on the slide rail 2 (28); the motor driving device is installed on the slide rail 2 (28) through a fixing device, and is electrically connected with a controller (not shown in the drawings). The improved electric slide rail further comprises a clutch 18 (39, 46) which is electrically connected with the controller, wherein the clutch 18 (39, 46) is arranged at a side where an output shaft of a motor 17 (41, 44) of the motor driving device is provided, and is connected with the slide rail 2 (28) through a linkage structure. According to the present invention, the clutch is introduced into the electric slide rail, the torque is transmitted between the motor and the slide rail when the clutch is closed, so that the motor drives the slide rail to move linearly along the fixed rail through the clutch and the linkage structure, so as to automatically push and pull the drawer. When the motor is powered off, the clutch is disconnected, the transmission between the motor and the slide rail is disconnected, so that the motor does not work when the drawer is manually pushed and pulled, and the drawer is able to be easily pushed and pulled without overcoming the torque of the motor. Therefore, the drawer is not only able to be pushed and pulled manually and automatically, but also able to be pushed and pulled manually easily when the motor is powered off. The improved electric slide rail provided by the present invention is simple in structure, convenient to use, and is also able to protect the service life of the motor.

As shown in FIGS. 2-4 and 11, the motor driving device further comprises an encoder 20 (42, 43, 47) for measuring the angular displacement of the motor or the gear. The fixing device comprises a supporting protective cover and a mounting bracket 7 (33, 36), wherein the motor driving device and the clutch 18 (39, 46) are installed within the supporting protective cover, the supporting protective cover is fixed to the slide rail 2 (28) through the mounting bracket 7 (33, 36), a support bracket 22 (40, 45) is provided within the supporting protective cover; the clutch 18 (39, 46) and the motor 17 (41, 44) are installed at two sides of the support bracket 22 (40, 45), respectively; the supporting protective cover has two support holes 32 at a left end and a right end thereof, respectively. Preferably, as shown in FIG. 1, the supporting protective cover comprises a front cover 12 (38, 37) and a rear cover 6 (34, 35) engaged with the front cover 12 (38, 37), the two support holes 32 are provided at the left end and the right end of the supporting protective cover where the front cover 12 (38, 37) is engaged with the rear cover 6 (34, 35), respectively. Moreover, concave-convex bearing structures, which are fitted with the motor, the clutch and the encoder, are provided at inner walls of the supporting protective cover for protecting the motor, the clutch and the encoder, respectively, which further improves the stability of the electric slide rail. The engagement method of the front cover and the rear cover facilitates assembly, disassembly, maintenance and processing.

Figure 6:
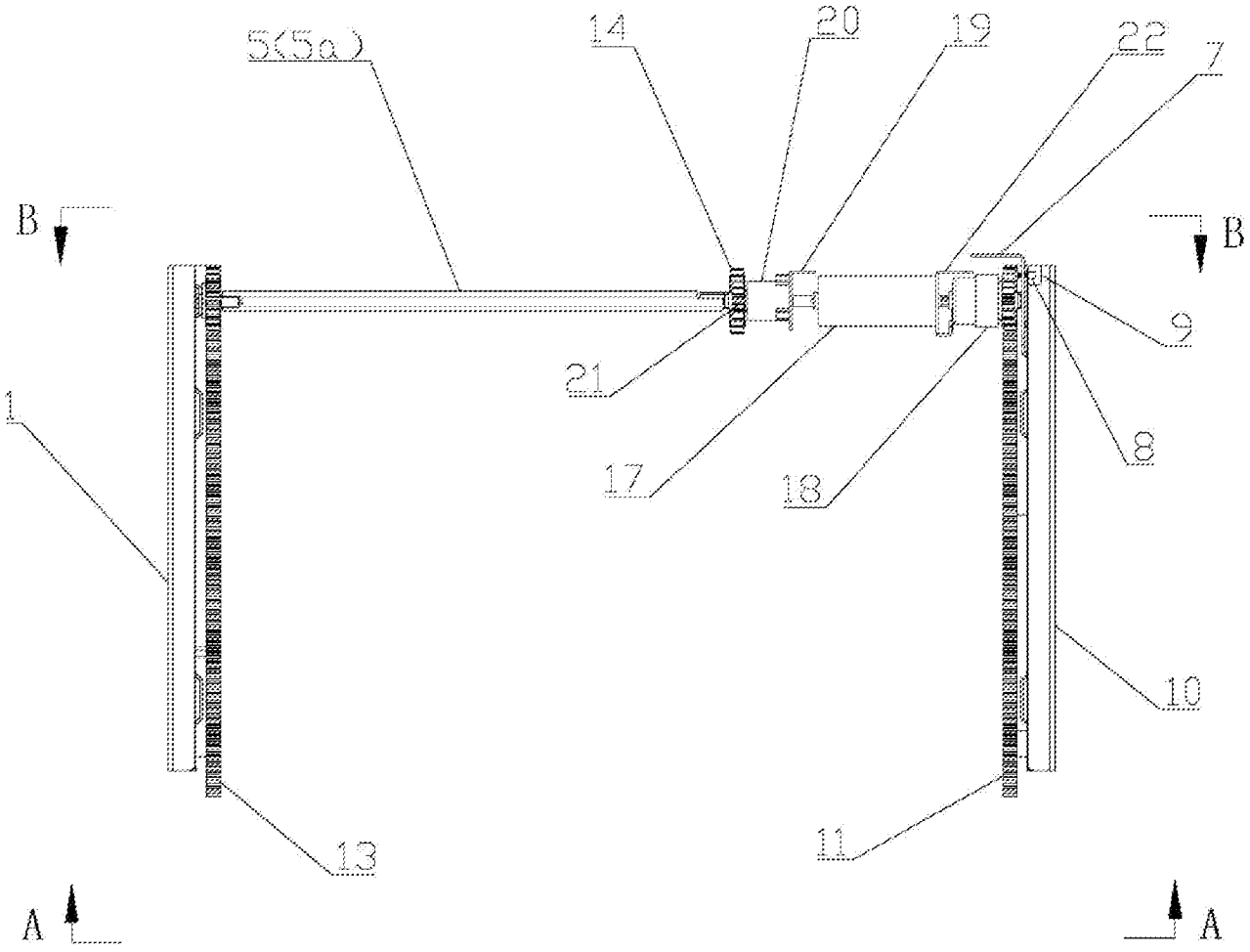
FIG. 6 is a top view of the motor driving device provided by the present invention, in which the supporting protective cover is removed.
Figure 7:
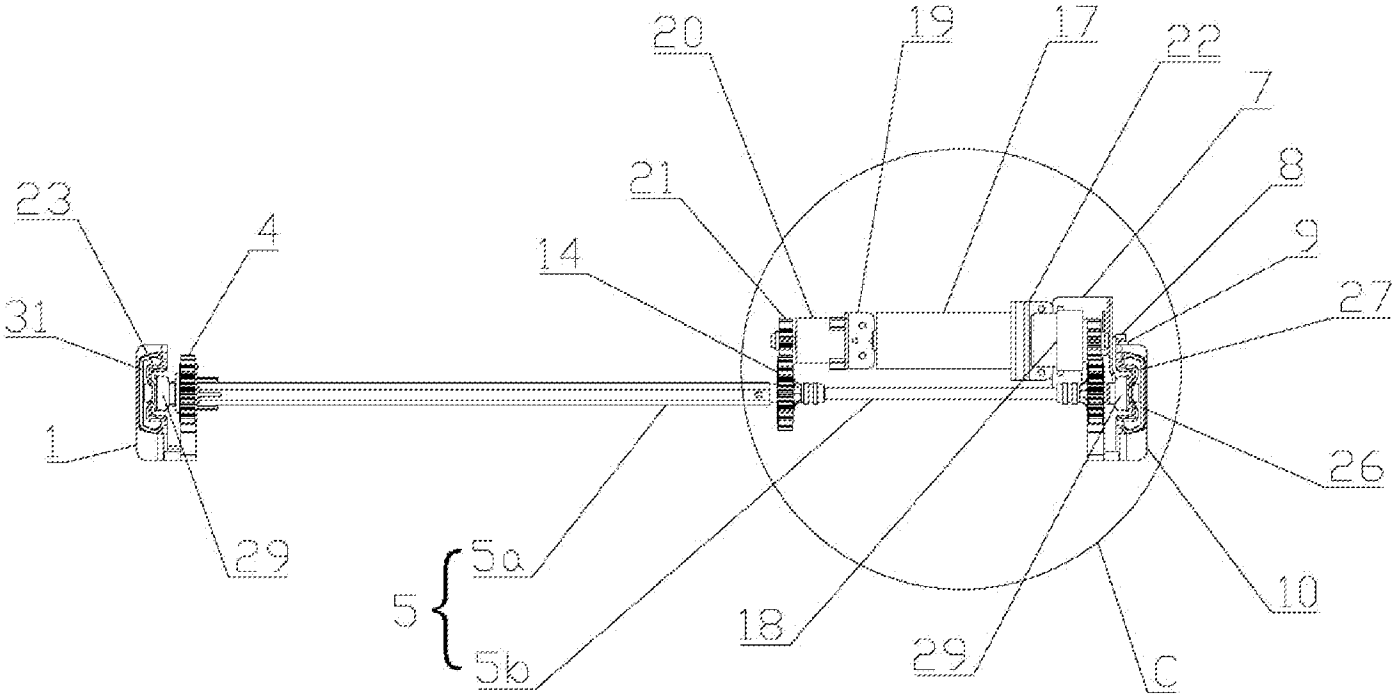
FIG. 7 is a structurally schematic view along A-A direction shown in FIG. 6, in which the supporting protective cover is removed.
Figure 14:
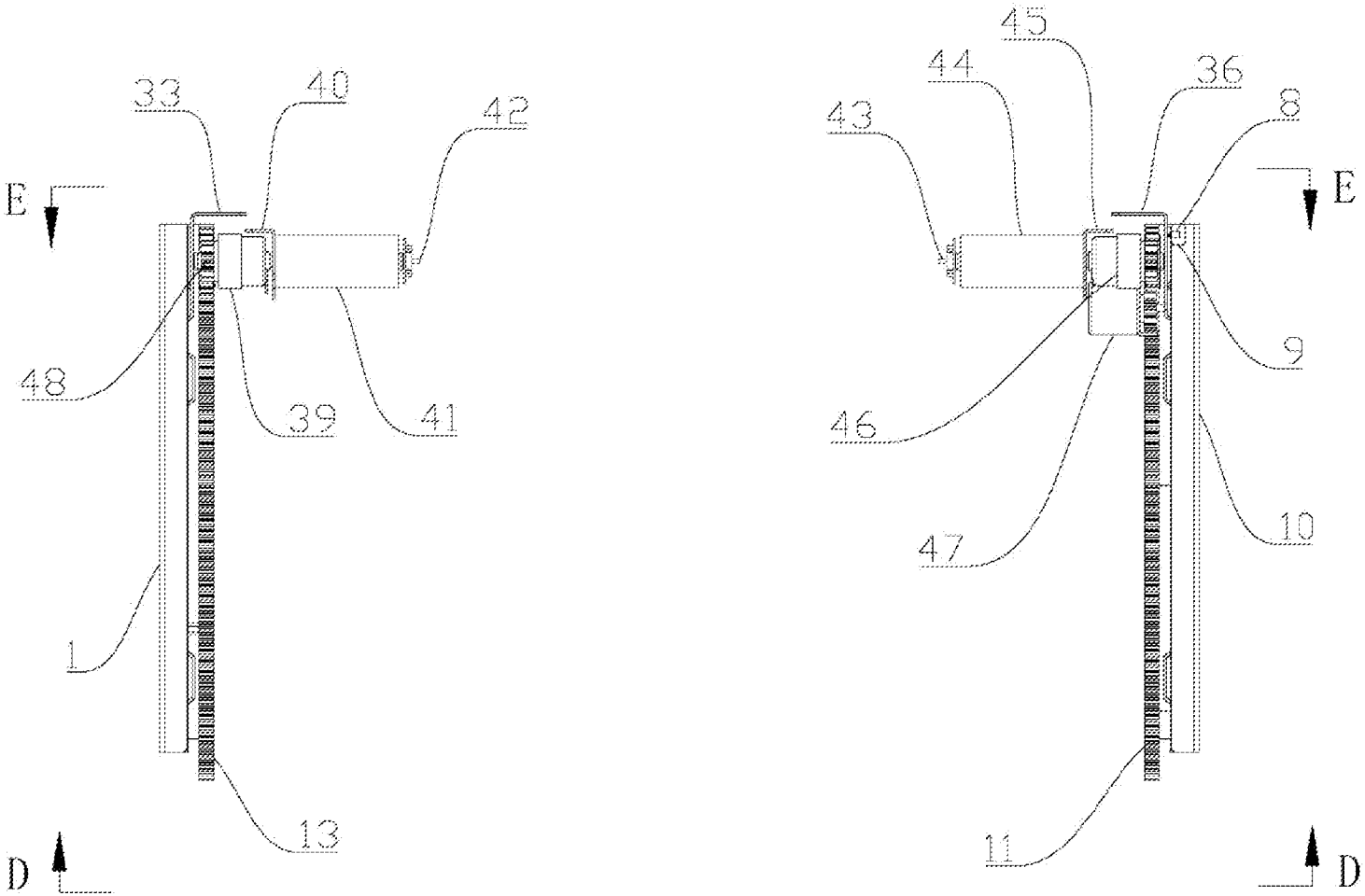
FIG. 14 is a top view of the two motor driving devices provided by the present invention, in which the first and second supporting protective covers are removed.

As shown in FIGS. 6 and 14, a magnet 9 is provided at a top of the rack housing 10, a Hall element 8 inductive with the magnet 9 is installed at the mounting bracket 7 (36). The Hall element and the magnet form a limit switch, so that while pulling and pushing the drawer, the position of the slide rail is able to be measured and judged. Preferably, referring to FIGS. 1 and 10, the magnet is installed at a top of a rear end portion of a second rack housing 10, the Hall element and the magnet form the limit switch in zero position, so as to measure and judge whether a second slide rail is at the zero position when it is closed, thereby ensuring that the drawer is able to be completely accommodated within the cabinet body when the drawer is in the closed state.

Figure 5:
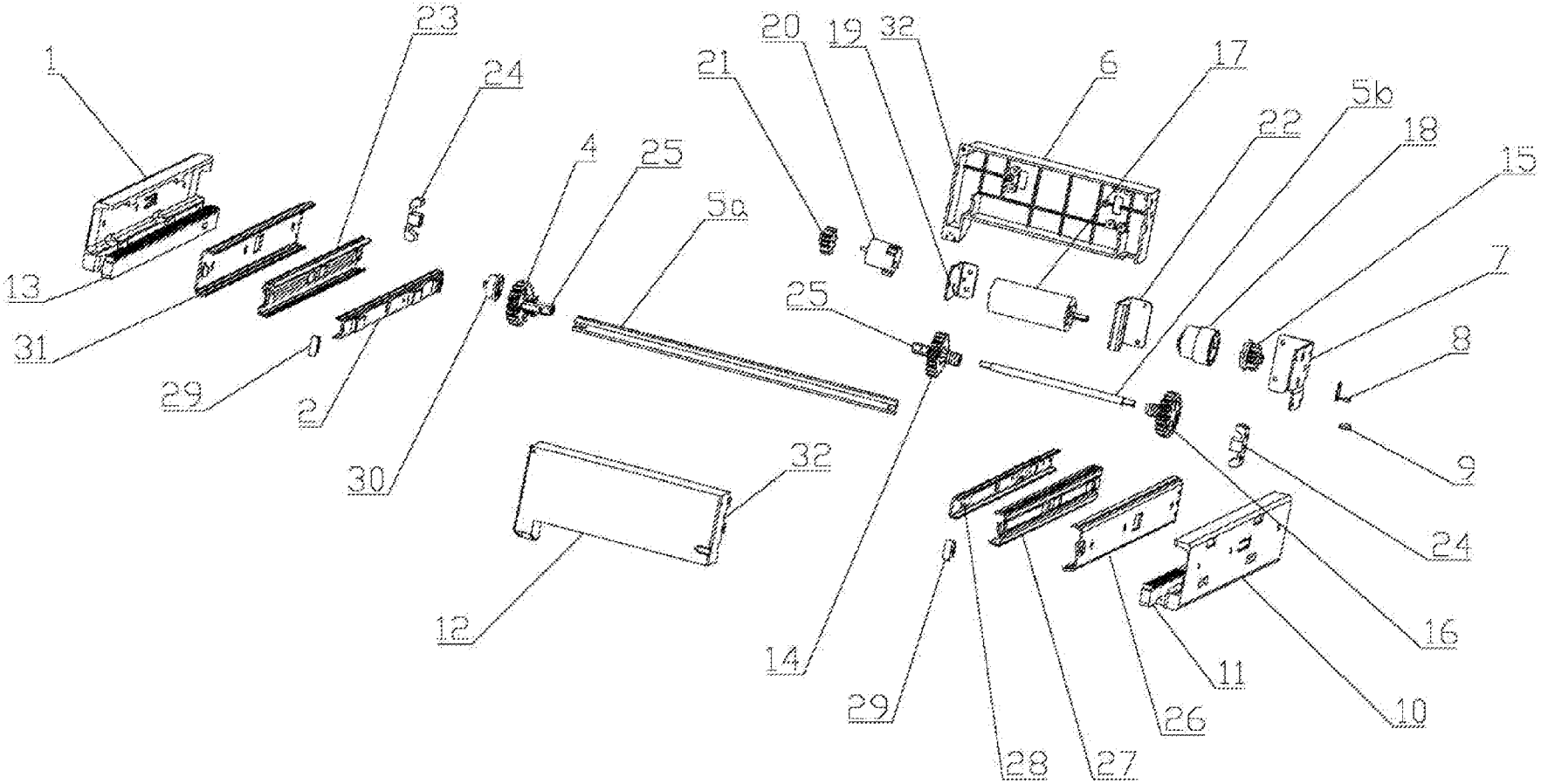
FIG. 5 is an exploded view of the motor driving device provided by the present invention.

As shown in FIGS. 5-9 and 13-16, the two slide rail assemblies are a first slide assembly and a second slide assembly; and accordingly, there are a first slide rail 2 and a second slide rail 28, there are a first fixed rail 31 and a second fixed rail 26, there are a first rack housing 1 and a second rack housing 10, there are a first rack 13 and a second rack 11, there are a first gear 4 and a second gear 16. Preferably, referring to FIGS. 1, 5, 10 and 13, two W-shaped anti-collision blocks 24 are installed at a rear end of the first fixed rail 31 and a rear end of the second fixed rail 26, respectively; two buffer blocks 29 are engaged with a front end of the first slide rail 2 and a front end of the second slide rail 28, respectively for buffering the impact force when the drawer is opened and closed, and simultaneously improving the mute effect of the electric slide rail. Both the first rack housing 1 and the second rack housing 10 are G-shaped, which facilitates installing the first and second fixed rails, and facilitates engaging the first and second gears on the first and second slide rails with the first and second racks, respectively, so as to ensure the sliding smoothness of the first and second slide rails. As shown in FIG. 5, the first gear 4 and the second gear 16 are connected with the first slide rail 2 and the second slide rail 28 through two gear seats 30, respectively, so as to improve the stability of the electric slide rail.

Figure 4:
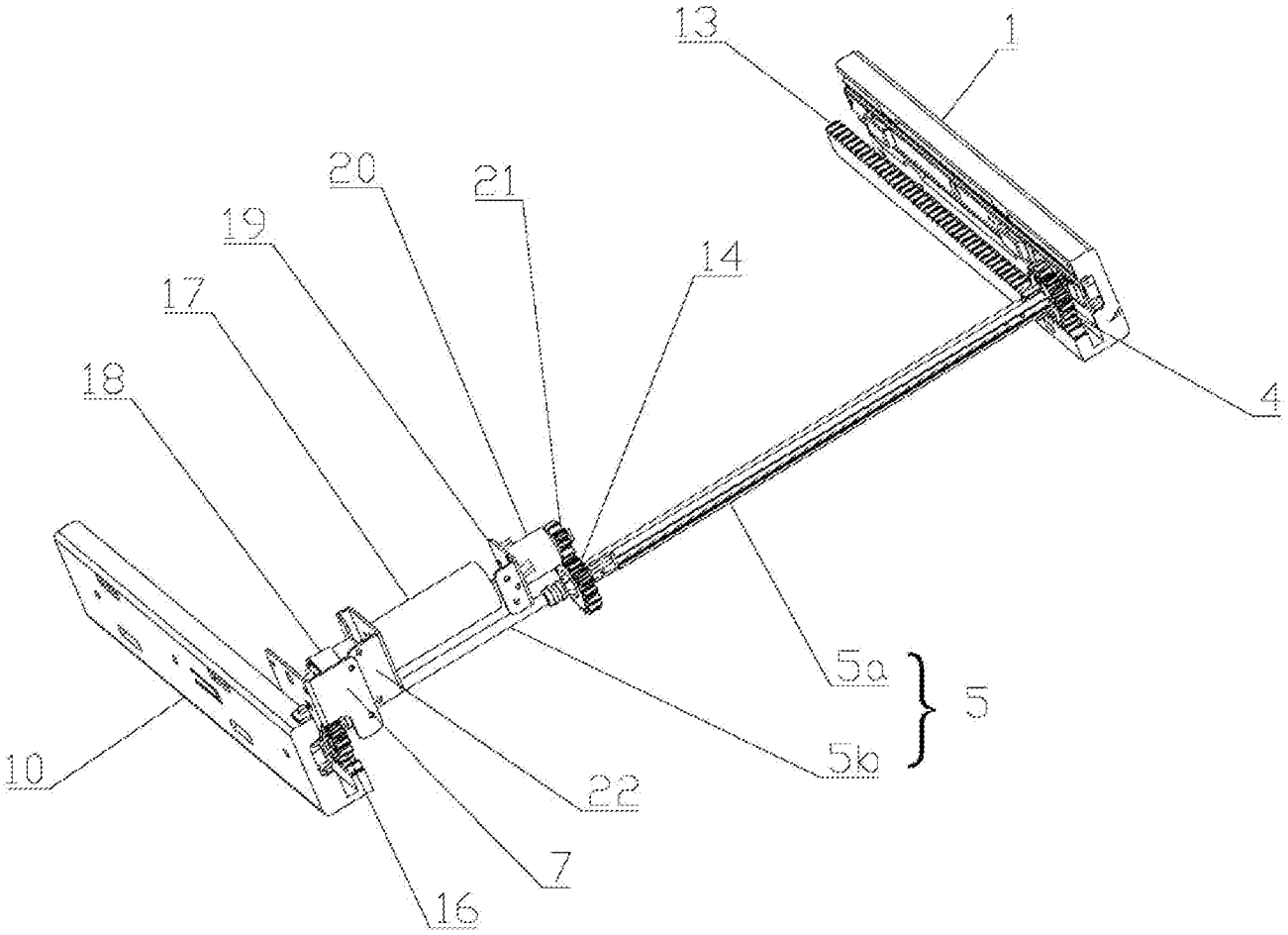
FIG. 4 is a partially exploded view of the motor driving device provided by the present invention from the third perspective, in which a supporting protective cover is removed.
Figure 8:
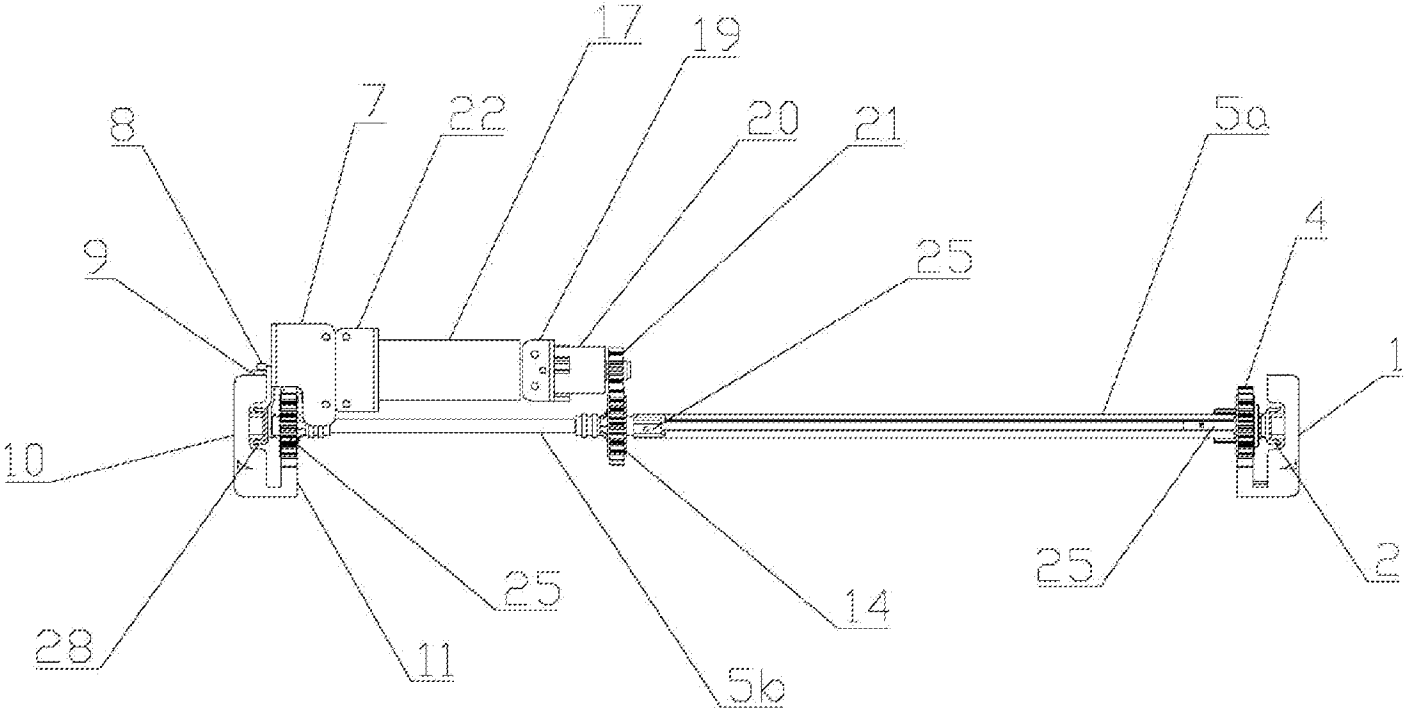
FIG. 8 is a structurally schematic view along B-B direction shown in FIG. 6, in which the supporting protective cover is removed.
Figure 9:
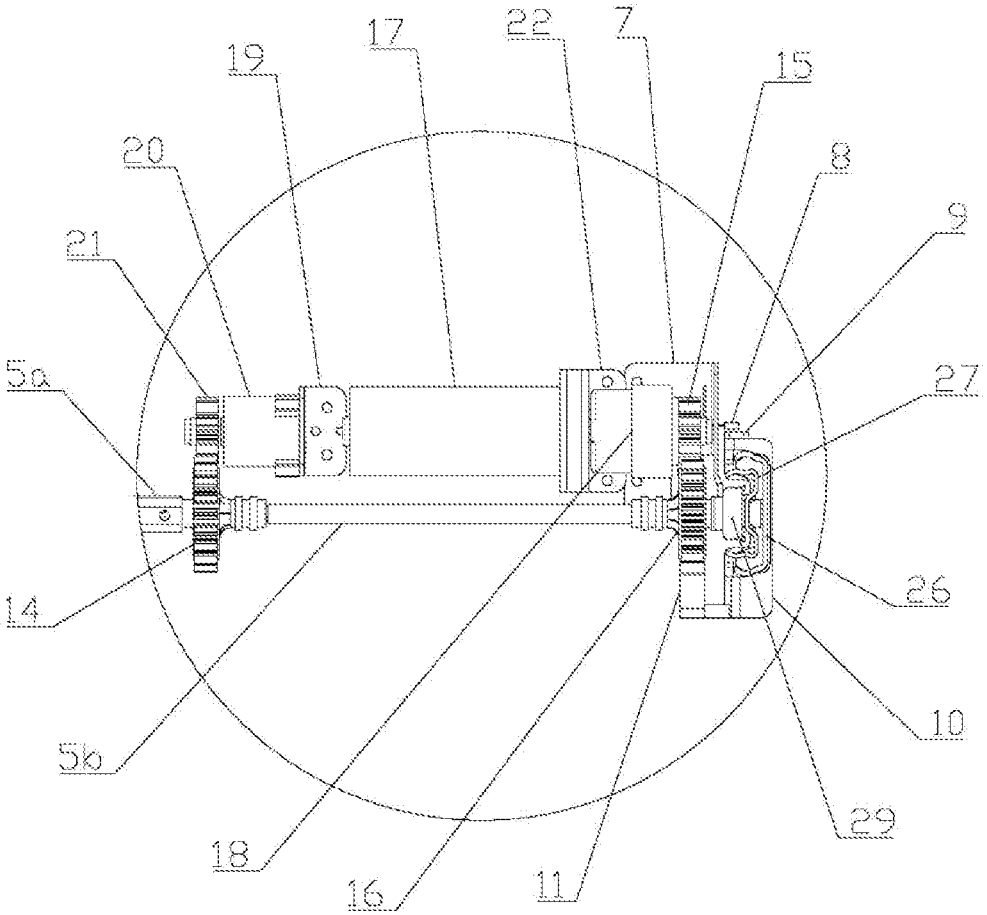
FIG. 9 is an enlarged schematic view of C shown in FIG. 7, in which the supporting protective cover is removed.
Figure 10:
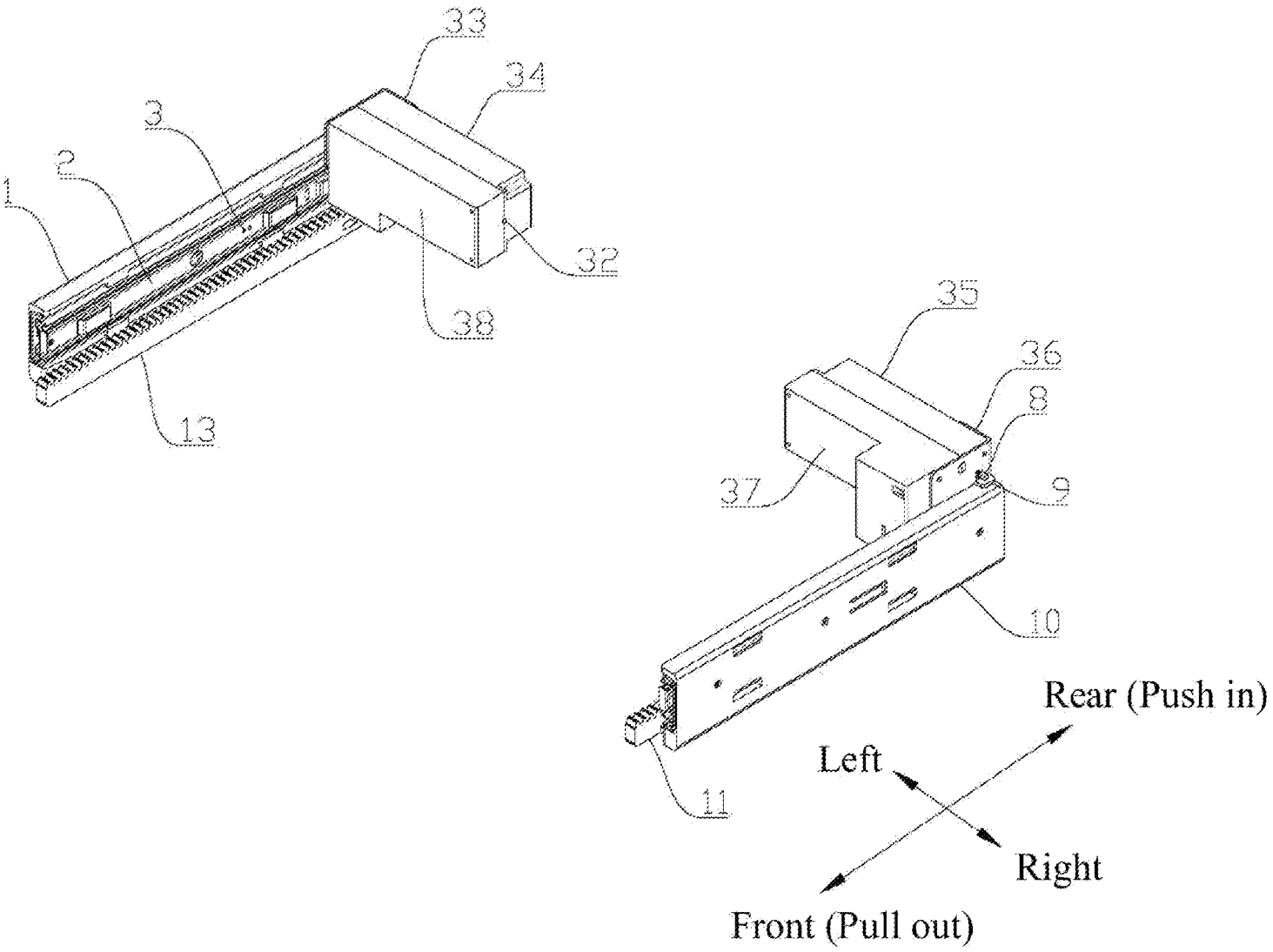
FIG. 10 is a three-dimensional schematic view of two motor driving devices provided by the present invention.
Figure 11:
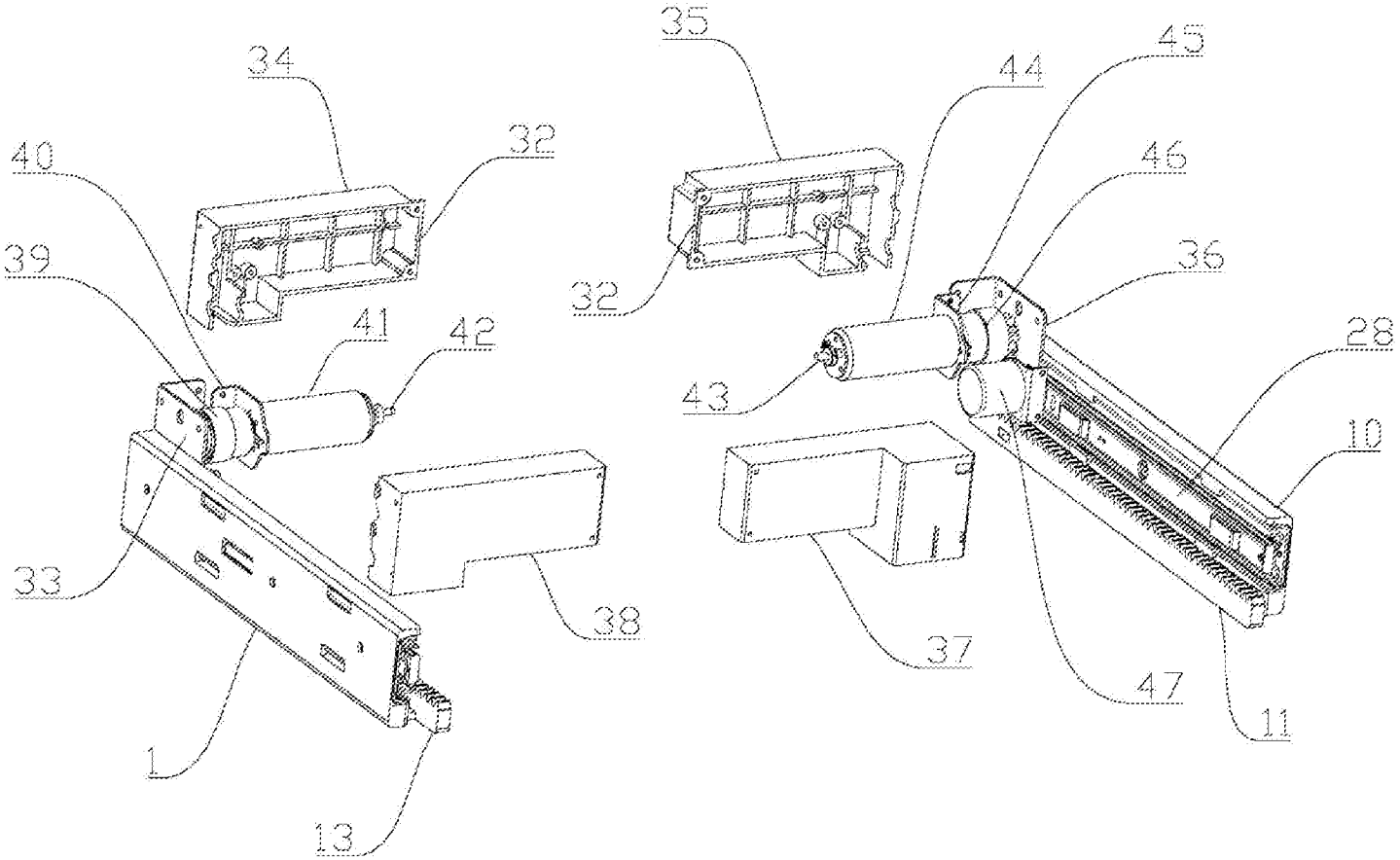
FIG. 11 is a partially exploded view of the two motor driving devices provided by the present invention from the first perspective.
Figure 12:
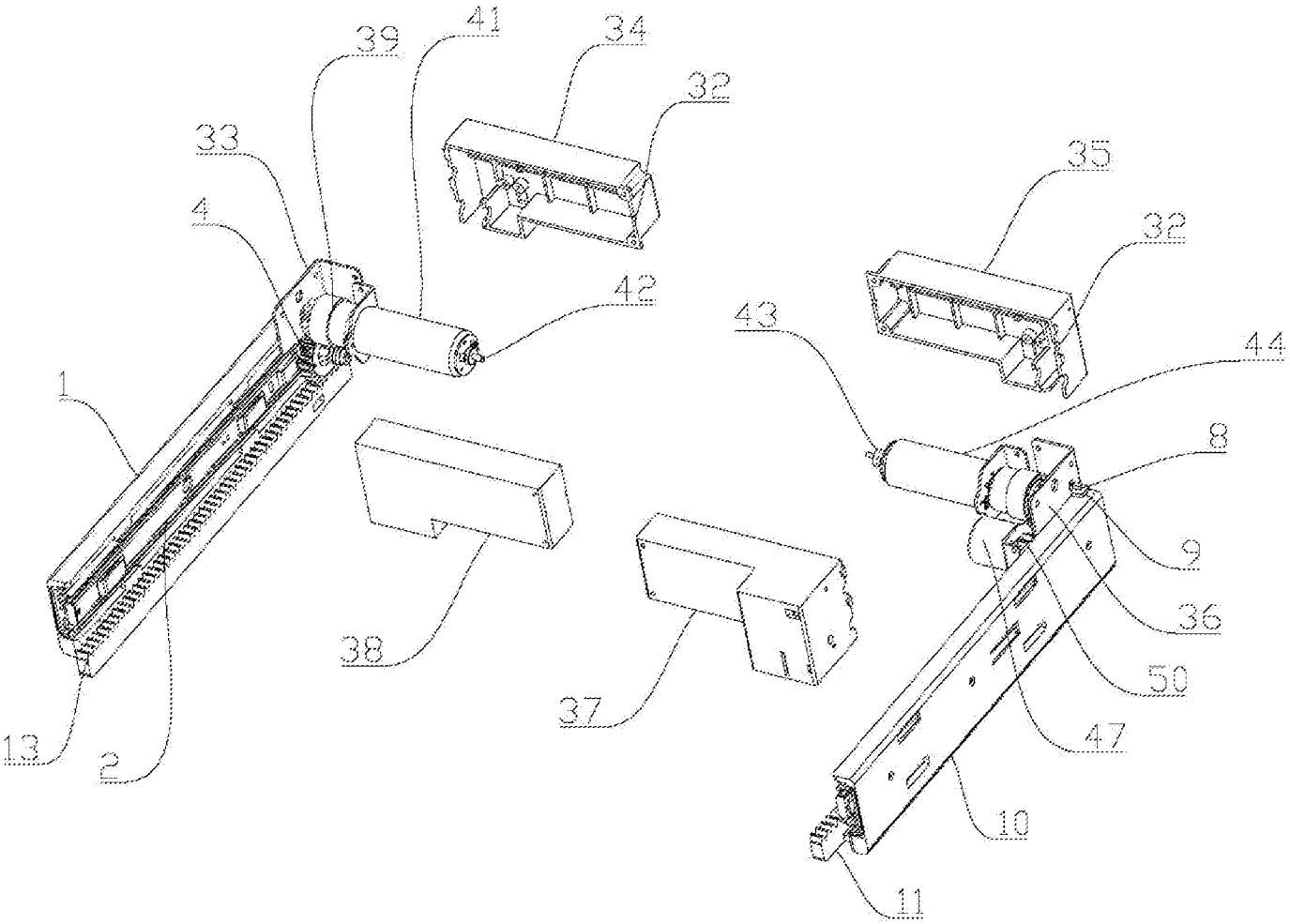
FIG. 12 is a partially exploded view of the two motor driving devices provided by the present invention from the second perspective.

Referring to FIGS. 1-9, the electric slide rail comprises one motor driving device. The linkage structure comprises a driving gear 15, wherein the driving gear 15 is engaged with the second gear 16, a left end of the driving gear 15 is installed on the clutch 18, a right end of the driving gear 15 is rotatably inserted into one of the two support holes 32 which is provided at the right end of the supporting protective cover. As shown in FIGS. 4, 5 and 9, a connecting rod 5 is provided between the first gear 4 and the second gear 16, a third gear 14 is sleeved on the connecting rod 5, the third gear 14 is engaged with a driven gear 21, a right end of the driven gear 21 is mounted on the encoder 20, a left end of the driven gear 21 is rotatably inserted into another of the two support holes 32 which is provided at the left end of the supporting protective cover, a support frame 19 is provided within the supporting protective cover, the encoder 20 is installed within the supporting protective cover through the support frame 19. Preferably, as shown in FIGS. 1-4, a front end and a rear end of both the support bracket 22 and the support frame 19 are fixed to the front cover 12 and the rear cover 6 of the supporting protective cover through bolts, respectively. The driving gear 15 and the second gear 16 engaged with the driving gear 15, the driven gear 21 and the third gear 14 engaged with the driven gear 21 are all provided within the supporting protective cover, so as to further improve the stability of the electric slide rail.

Referring to FIG. 9, the encoder 20 is configured to measure the angular displacement of the third gear 14 through the driven gear 21. When the drawer is pushed and pulled manually, the encoder 20 feeds back the angular displacement signal of the third gear 14 to the controller (not shown) which is electrically connected with the encoder 20, and the clutch 18 is controlled by the controller to start the motor 17, so as to drive the second slide rail 28 to move linearly along the second fixed rail 26 through the driving gear 15 and the second gear 16, and then to drive the first slide rail 2 to move synchronously along the first fixed rail 31 through the connecting rod 5, thereby changing from manual to automatic push-pull drawer. When the motor is powered off, the clutch is separated, the transmission between the motor and second slide rail is disconnected, the automatic push-pull drawer is stopped, which is convenient to manually push and pull the drawer, thereby effectively improving the stability and safety of the electric slide rail.

Referring to FIGS. 4 and 5, the connecting rod 5 comprises a transverse rod 5*a* and a linkage rod 5*b*, the first gear 4 is installed at a left end of the transverse rod 5*a*, a right end of the transverse rod 5*a* is connected with a left end of the linkage rod 5*b* through the third gear 14, the second gear 16 is installed at a right end of the linkage rod 5*b*, so as to move synchronously the first slide rail assembly and the second slide rail assembly to stably open and close the drawer. Referring to FIG. 8, the transverse rod 5*a* has a channel, the first gear 4 and the third gear 14 are engaged with the left end and the right end of the transverse rod 5*a* through a square inserting rod 25, which is convenient for assembly, disassembly and maintenance.

Referring to FIGS. 10-16, the electric slide rail comprises two motor driving devices, namely, a first motor driving device and a second motor driving device. Accordingly, there are two motors, namely, a first motor 41 and a second motor 44; there are two clutches, namely, a first clutch 39 and a second clutch 46; there are two linkage structures, namely, a first linkage structure and a second linkage structure; there are two fixing device, namely, a first fixing device and a second fixing device; there are three encoders, namely, a first encoder 42 installed at the first motor 41, a second encoder 43 installed at the second motor 44 and a third encoder 47 connected with the second slide rail 28.

Referring to FIGS. 10 to 13, the first fixing device comprises a first supporting protective cover and a first mounting bracket 33, the first supporting protective cover comprises a first front cover 38 and a first rear cover 34, a first support bracket 40 is provided within the first supporting protective cover, the first clutch 39 is arranged at a side of an output shaft of the first motor 41, the first support bracket 40 is located between the first clutch 39 and the first motor 41. The first linkage structure comprises a first driving gear 48, wherein the first driving gear 48 is engaged with the first gear 4, a left end of the first driving gear 48 is rotatably inserted into a support hole 32 which is provided at a left end of the first supporting protective cover, a right end of the first driving gear 48 is connected with the first clutch 39, a left end of the first encoder 42 is connected with a right end of the first motor 41, a right end of the first encoder 42 is rotatably inserted into a support hole 32 which is provided at a right end of the first supporting protective cover.

Referring to FIGS. 10 to 13, the second fixing device comprises a second supporting protective cover and a second mounting bracket 36, the second supporting protective cover comprises a second front cover 37 and a second rear cover 35, a second support bracket 45 is provided within the second supporting protective cover, the second clutch 46 is arranged at a side of an output shaft of the second motor 44, the second support bracket 45 is located between the second clutch 46 and the second motor 44. The second linkage structure comprises a second driving gear 49, wherein the second driving gear 49 is engaged with the second gear 16, a left end of the second driving gear 49 is connected with the second clutch 46, a right end of the second driving gear 49 is rotatably inserted into a support hole 32 which is provided at a right end of the second supporting protective cover, a right end of the second encoder 43 is connected with a left end of the second motor 44, a left end of the second encoder 43 is rotatably inserted into a support hole 32 which is provided at a left end of the second supporting protective cover. The first encoder and the second encoder, both of which are electrically connected with the controller, are configured to measure the angular displacement of the first motor and the second motor, respectively, so as to improve the synchronization of the first slide rail and the second slide rail, thereby stably and smoothly pulling and pushing the drawer.

Referring to FIGS. 14 and 16, the first supporting protective cover is fixed to the first slide rail 2 through the first mounting bracket 33; the first front cover 38 and the first rear cover 34 are installed at a front end and a rear end of the first support bracket 40, respectively; the second supporting protective cover is fixed to the second slide rail 28 through the second mounting bracket 36; the second front cover 37 and the second rear cover 35 are installed at a front end and a rear end of the second support bracket 45, respectively, so as to improve the stability of the electric slide rail.

Referring to FIGS. 12-15, a third support bracket 51 is provided within the second supporting protective cover, the third encoder 47 is fixed on the third support bracket 51, an encoder gear 50 is installed at an end portion of the third encoder 47, the encoder gear 50 is engaged with the second gear 16. Preferably, as shown in FIG. 15, the third encoder 47 is located below the second clutch 46, the encoder gear 50 is engaged with the second gear 16 at a front end thereof; the second front cover 37 and the second rear cover 35 are installed at two ends of the third support bracket 51, respectively, which is convenient for the third encoder 47 to measure the angular displacement of the second gear 16, and further improving the stability of the electric slide rail.

Referring to FIGS. 1-2 and 10-11, the motor driving device and the clutch are installed on the slide rail through the supporting protective cover and the mounting bracket of the fixing device. The motor driving device is installed from the side of the drawer, so that the motor driving device is located at the rear of the drawer, which effectively reduces the gap between the side wall of the drawer and the inner wall of the cabinet, prevents foreign matter such as dust from entering from both sides of the drawer when the drawer is pushed and pulled, and prolongs the service life of the electric slide rail. Compared with the electric slide rail with motors installed on both sides, the present invention is able to effectively increase the volume of the drawer.

Figure 13:
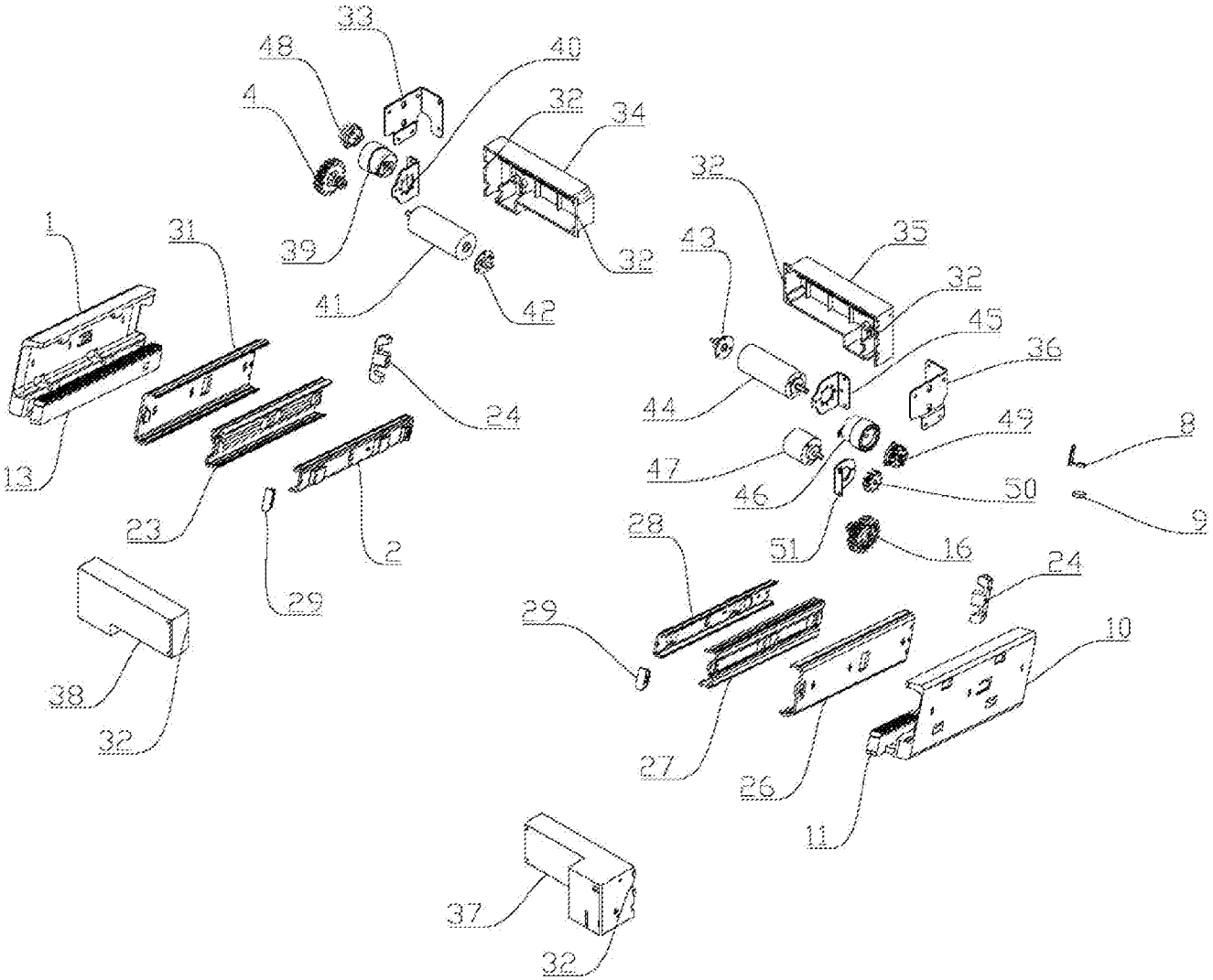
FIG. 13 is an exploded view of the two motor driving devices provided by the present invention.

The working principle of the electric slide rail provided by the present invention is as follows. Taking a three-section slide rail as an example, as shown in FIGS. 5 and 13, the first slide rail assembly further comprises a first middle rail 23 that bridges the first fixed rail 31 and the first slide rail 2, and the second slide rail assembly also comprises a second middle rail 27 that bridges the second fixed rail 26 and the second slide rail 28; the first fixed rail 31 and the second fixed rail 26 are fixed on two opposite side walls of the cabinet through the first rack housing 1 and the second rack housing 10, respectively; the first slide rail 2 and the second slide rail 28 are connected with an outer side wall of the drawer through the mounting hole 3.

When there is a motor driving device, the working principle is described as follows. As shown in FIGS. 1-9, while opening the drawer in a pulling direction (or closing the drawer in a pushing direction), firstly, a user touches a touch switch (not shown in the drawings) which is located at a wall of a drawer door and is electrically connected with the controller, the touch switch sends a start signal to the controller (not shown in the drawings); or the user directly opens (or closes) the drawer manually, the encoder 20 for measuring the angular displacement of the third gear 14 generates the start signal and transmits the start signal to the controller; secondly, the clutch 18 and the motor 17 are controlled by the controller, and the driving gear 15 is driven to rotate through the clutch 18 for driving the second gear 16 meshing with the driving gear 15 to rotate along the second rack 11, the first gear 4 at the left end of the connecting rod 5 rotates synchronously along the first rack 13, so that the first slide rail 2 and the second slide rail 28 synchronically linearly move along the first fixed rail 31 and the second fixed rail 26, respectively, thus the drawer is opened immediately (or the drawer is closed).

When there are two motor driving devices, the working principle is described as follows. As shown in FIGS. 10-16, while opening the drawer in a pulling direction through pulling the first slide rail and the second slide rail (or closing the drawer in a pushing direction through pushing the first slide rail and the second slide rail), firstly, a user touches a touch switch (not shown in the drawings) which is located at a wall of a drawer door and is electrically connected with the controller, the touch switch sends a start signal to the controller (not shown in the drawings); or the user directly opens (or closes) the drawer manually, the third encoder 47 for measuring the angular displacement of the second gear 16 generates the start signal and transmits the start signal to the controller; secondly, the first clutch 39 and the first motor 41 are controlled by the controller, the first driving gear 48 is driven to rotate through the first clutch 39 for driving the first gear 4 meshing with the first driving gear 48 to rotate along the first rack 13, and the second clutch 46 and the second motor 44 are controlled by the controller, the second driving gear 49 is driven to rotate through the second clutch 46 for driving the second gear 16 meshing with the second driving gear 49 to rotate along the second rack 11, so that the first slide rail 2 and the second slide rail 28 synchronically linearly move along the first fixed rail 31 and the second fixed rail 26, respectively, thus the drawer is opened immediately (or the drawer is closed). The first encoder 42 and the second encoder 43 are able to feed back the angular displacement of the first motor 41 and the second motor 44 in real time, respectively, thereby effectively ensuring synchronization of the first slide rail assembly and the second slide rail assembly.

When the motor is in the power-off state, the clutch is disconnected, thereby cutting off the transmission connection between the motor and the slide rail. When manually pushing and pulling the drawer, there is no need to overcome the torque of the motor, the first gear and the second gear move along the first rack and second rack, respectively, so as to drive the first slide rail connected with the first gear and the second slide rail connected with the second gear to move linearly simultaneously, so that the drawer is opened or closed immediately, which is very convenient.

In particular, when the motor and the clutch are in the power-off state, the drawer is stuck or pulled out of place, it is pulled and pushed manually. When the electric slide rail comprises a motor driving device, the encoder 20 is configured to measure the angular displacement of the third gear 14 and feeds back to the controller. When the electric slide rail comprises two motor driving devices, the third encoder 47 is configured to measure the angular displacement of the second gear 16 and feeds back to the controller. The clutch and the motor are controller by the controller for driving the slide rail to move, so that the drawer is pulled and pushed from manual mode to automatic mode, thereby improving the stability and safety of the electric slide rail.

What is claimed is:

1. An electric slide rail, comprising a first motor driving device, a first slide rail assembly, a second slide rail assembly both of which are symmetrically arranged to each other and have a same structure, and a first clutch, wherein:

the first slide rail assembly comprises a first slide rail and a first fixed rail, wherein the first slide rail is slidably sleeved within the first fixed rail, a first rack housing is sleeved on an outer side of the first fixed rail, a first rack is provided on the first rack housing, a first gear engaged with the first rack is mounted on the first slide rail;

the first clutch is arranged at a side where an output shaft of a first motor of the first motor driving device is provided, and is connected with the first slide rail through a first linkage structure;

the first motor driving device, which is installed on the first slide rail through a first fixing device, comprises a first encoder for measuring motor or gear angular displacement; the first fixing device comprises a first supporting protective cover and a first mounting bracket, wherein the first motor driving device and the first clutch are installed within the first supporting protective cover, the first supporting protective cover is fixed to the first slide rail through the first mounting bracket;

a first support bracket is provided within the first supporting protective cover; the first clutch and the first motor are installed at two sides of the first support bracket, respectively; the first supporting protective cover has two support holes at a left end and a right end thereof, respectively;

the first linkage structure comprises a first driving gear, wherein the first driving gear is engaged with a second gear, a left end of the first driving gear is installed on the first clutch, a right end of the first driving gear is rotatably inserted into one of the two support holes which is provided at the right end of the first supporting protective cover; a connecting rod is provided between the first gear and the second gear, a third gear is sleeved on the connecting rod, the third gear is engaged with a first driven gear, a right end of the first driven gear is mounted on the first encoder, a left end of the first driven gear is rotatably inserted into another of the two support holes which is provided at the left end of the supporting protective cover; a first support frame is provided within the first supporting protective cover, the first encoder is installed within the first supporting protective cover through the first support frame.

2. The electric slide rail according to claim 1, wherein the first connecting rod comprises a first transverse rod and a first linkage rod, the first gear is installed at a left end of the first transverse rod, a right end of the first transverse rod is connected with a left end of the first linkage rod through the third gear, the second gear is installed at a right end of the first linkage rod.

3. The electric slide rail according to claim 2, wherein the first transverse rod has a channel, the first gear and the third gear are engaged with the left end and the right end of the first transverse rod through a square inserting rod.

4. The electric slide rail according to claim 3, wherein a third support bracket is provided within the second supporting protective cover, the third encoder is fixed on the third support bracket, an encoder gear is installed at an end portion of the third encoder, the encoder gear is engaged with the second gear.

5. The electric slide rail according to claim 4, further comprising a second clutch and a second motor driving device, wherein:

the second slide rail assembly comprises a second slide rail and a second fixed rail, wherein the second slide rail is slidably sleeved within the second fixed rail, a second rack housing is sleeved on an outer side of the second fixed rail, a second rack is provided on the second rack housing, the second gear engaged with the second rack is mounted on the second slide rail;

the second clutch is arranged at a side where an output shaft of a second motor of the second motor driving device is provided, and is connected with the second slide rail through a second linkage structure;

the second motor driving device, which is installed on the second slide rail through a second fixing device, comprises a second encoder for measuring motor or gear angular displacement; the second fixing device comprises a second supporting protective cover and a second mounting bracket, wherein the second motor driving device and the second clutch are installed within the second supporting protective cover, the second supporting protective cover is fixed to the second slide rail through the second mounting bracket;

a second support bracket is provided within the second supporting protective cover; the second clutch and the second motor are installed at two sides of the second support bracket, respectively; the second supporting protective cover has two support holes at a left end and a right end thereof, respectively;

the second linkage structure comprises a second driving gear, wherein the second driving gear is engaged with the first gear, a left end of the second driving gear is installed on the second clutch, a right end of the second driving gear is rotatably inserted into one of the two support holes which is provided at the right end of the second supporting protective cover; a connecting rod is provided between the first gear and the second gear, the third gear is sleeved on the connecting rod, the third gear is engaged with a second driven gear, a right end of the second driven gear is mounted on the second encoder, a left end of the second driven gear is rotatably inserted into another of the two support holes which is provided at the left end of the second supporting protective cover; a second support frame is provided within the second supporting protective cover, the second encoder is installed within the second supporting protective cover through the second support frame.

* * * * *